US005480536A

United States Patent [19]

Suehiro et al.

[11] Patent Number: 5,480,536

[45] Date of Patent: Jan. 2, 1996

[54] CORROSION-INHIBITED IRON-BASED MEMBERS AND METHOD OF PRODUCING THE SAME

[75] Inventors: Atsuo Suehiro, Nishin; Norio Kogashiwa, Owariasahi, both of Japan

[73] Assignee: Kowa Industry Works Co., Ltd., Nagoya, Japan

[21] Appl. No.: 265,012

[22] Filed: Jun. 24, 1994

[30] Foreign Application Priority Data

Jun. 29, 1993 [JP] Japan ..... 5-187234

[51] Int. Cl.[6] ..... C25D 5/48

[52] U.S. Cl. ..... 205/151; 205/196; 205/227; 205/243; 205/917

[58] Field of Search ..... 205/151, 196, 205/227, 917, 243; 428/626, 667

[56] References Cited

U.S. PATENT DOCUMENTS

| | | | |
|---|---|---|---|
| 3,928,157 | 12/1975 | Suematsu et al. | 204/181 |
| 4,065,365 | 12/1977 | Ibarguengoitia | 205/151 |
| 4,094,749 | 6/1978 | Stange et al. | 428/626 |
| 5,312,868 | 5/1994 | Abe et al. | 525/124 |

FOREIGN PATENT DOCUMENTS

| | | |
|---|---|---|
| 60-33369 | 2/1985 | Japan . |
| 64-28396 | 1/1989 | Japan . |
| 4160197 | 6/1992 | Japan . |

*Primary Examiner*—John Niebling
*Assistant Examiner*—Edna Wong
*Attorney, Agent, or Firm*—Cushman Darby & Cushman

[57] ABSTRACT

A corrodible iron-based work such as a cylinder rod is subjected to hard chrome plating, heat-treatment by high frequency heating or baking at a temperature of not less than 150° C. (e.g. 170° to 600° C.), resin impregnation treatment and finish buffing in that order to produce a corrosion-inhibited member. In the impregnation step, a thermosetting resin may be impregnated under subatmospheric pressure. After the impregnation step, the thermosettable resin or sealant may be cured in a curing step. The present invention provides for an remarkably high degree of corrosion resistance even though the thickness of the hard chrome plating layer is small.

8 Claims, No Drawings

CORROSION-INHIBITED IRON-BASED MEMBERS AND METHOD OF PRODUCING THE SAME

FIELD OF THE INVENTION

The present invention relates to a corrosion-inhibited iron-based member and to a method of producing a corrosion-inhibited member, which is capable of imparting a high degree of corrosion resistance to a corrodible iron-based work and suited for the manufacture of cylinder rods, etc. for use in construction machinery, industrial machinery and industrial carriages or vehicles.

BACKGROUND OF THE INVENTION

In the hydraulic mechanisms of construction machines such as the power shovel, cylinder rods inclusive of piston rods, etc. are conventionally used. Such rods, slidable against cylinders, must satisfy several characteristic requirements such as high hardness, high wear resistance and high dimensional accuracy inclusive of surface accuracy. Therefore, rods for cylinder use are generally fabricated by applying hard chrome plating to iron-based substrate rods.

However, the hard chrome plating layer so formed, unlike other electroplating layers, tends to develop various defects such as cracks, pinholes and pits even when its thickness is as great as the order of 100 μm. Therefore, despite its various meritorious characteristics, the rod carrying a hard chrome plating layer is more or less readily corroded and rusted. Particularly in the presence of chloride ions, e.g. sodium chloride, or acids or under high-temperature, high-humidity field conditions, the rod undergoes serious corrosion due to the numerous defects. As the rod is corroded, it is damaged on repeated sliding against the cylinder to cause hydraulic oil leaks.

To prevent corrosion of hard-chrome-plated members, it is common practice to apply a rust inhibitor to the surface of the members and let the inhibitor penetrate into the defects but this practice is hardly a radical solution to the problem. For the prevention of corrosion of hard-chrome-plated members, it is also practiced to form a plating layer as thick as about 0.05 to 0.1 mm. However, increasing the thickness of the plating layer results in decreased productivity.

Japanese Patent Publication No. 3-14913 (JP-B-3 (1991)-14913) describes a process for applying a high-quality mirror-surface chrome plating which comprises forming a plating layer approximately twice as thick as a finished plating layer on an iron-based work using a microcrack type chrome plating bath, baking the plating layer under rugged conditions (at a temperature 40°–60° C. higher than the upper critical standard field operating temperature for 40–50 hours), removing 40–50% of the plating layer by buffing, baking the buffed layer under mild conditions (at a temperature 10°–20° C. higher than the upper critical standard field operating temperature for 20–30 hours) and finishing the surface by buffing or polishing.

This method, however, is not only uneconomical because a very thick plating layer must be first formed and 40–50% of the layer be then removed but also low in productivity because these operations are time-consuming. Furthermore, the two baking steps required are also time-consuming. Therefore, the productivity of drums or rolls, for instance, is seriously low. In addition, corrosion resistance is not a parameter considered in the above prior art literature.

Japanese Patent Application No. 60-33369 (JP-A-60 (1985)-33369) discloses a method of inhibiting corrosion which comprises chrome-plating a metal work, heating the same at a temperature of 120 +/– 10° C.3 for 5 to 30 minutes to remove the hydrogen gas evolved in the course of plating and coating the plating layer with an anticorrosive composition comprising a mixture of 20 to 80 weight % of an unsaturated polyester and 80 to 20 weight % of diallyl phthalate. The resultant metal work, however, is insufficient in corrosion resistance as shown in Comparative Example.

In Japanese Patent Application No. 4-160197 (JP-A-4 (1992)-160197), a method of improving the corrosion resistance of cylinder rods which comprises subjecting a cylinder rod to hard chrome plating and, then, to baking. The present invention has for its object to further improve the corrosion resistance of hard-chrome-plated iron-based members such as cylinder rods.

SUMMARY OF THE INVENTION

It is, therefore, an object of the present invention to provide a corrosion-inhibited iron-based member having an extremely high degree of corrosion resistance even when a hard-chrome-plating layer has a reduced thickness and a process for producing such members.

It is a further object of the present invention to provide a corrosion-inhibited iron-based member having a corrosion resistance at least comparable or even superior to that of stainless steel despite the use of an iron-based material having corrosion properties as the starting work.

It is a still further object of the present invention to provide a process for producing corrosion-inhibited iron-based members which is especially useful for the manufacture of cylinder rods having the above-mentioned meritorious characteristics.

To accomplish the above objects, the inventors of this invention did much exploration and found that hard-chrome-plating followed by heat treatment at a specified temperature and resin impregnation results in a marked enhancement of corrosion resistance. This invention has been accomplished on the basis of the above findings.

In the method of this invention, an iron-based work is subjected to hard chrome plating, heat-treatment at a temperature of not less than 150° C., resin impregnation treatment and finish buffing to produce a corrosion-inhibited (suppressed) member.

In the process, the thickness of the hard chrome plating layer formed in the plating step may for example be from about 10 μm to about 100 μm and the temperature of the heat treatment may for example be about 170° to 600° C. As the impregnating resin or sealant, a thermosetting or other resin may be used and the resin impregnation can be carried out at subatmospheric pressure. The impregnated resin or sealant may be cured in a curing step.

The method of the present invention provides for an remarkably high degree of corrosion resistance. For example, the method may provide a corrosion-inhibited iron-based member with a rating number of about 9.0 to 10.0 in the 96-hour CASS (copper accelerated acetic acid salt spray) test according to JIS H 8502 and/or a rating number of about 9.8 to 10.0 in the 1,200-hour salt spray test according to JIS H 8502. Therefore, the corrosion-inhibited iron-based member according to the present invention is suited for applications calling for sustained corrosion resistance even under rugged field conditions, for example piston rods and other cylinder rods.

DETAILED DESCRIPTION OF THE INVENTION

The iron-based work mentioned above may be of any of various known Fe series materials such as low carbon steel, high carbon steel, hardened steel, high speed steel, chromium steel, nickel steel, nickel-chromium steel, nickel-chromium-molybdenum steel, tungsten steel, and so on. The present invention is applied suitably to a corrodible iron-based work since a remarked improvement in corrosion resistance can be imparted to corrodible members by the method of the invention.

The corrodible iron-based work mentioned above is not restricted in shape but may for example be planar, curved planar, polygonal in section, cylindrical or of hollow structure. Among the iron-based members in which high corrosion resistance is required are cylindrical and other rod-shaped members (e.g. piston rods and other cylindrical rods).

Prior to chrome plating, the iron-based work is generally pretreated. In this pretreatment stage, the Work is subjected to a degreasing treatment such as organic solvent or alkali soak cleaning, alkaline electrolytic or other degreasing and, where necessary, acid pickling with hydrochloric acid, sulfuric acid or the like.

Furthermore, where necessary, the chrome plating of an iron-based work may be preceded by buffing. Buffing of the iron-based work can be performed by the conventional methods, for example by buffing with a cylindrical abrasive sleeve (ring buffing), vertical buffing, etc., which involve a large abrasive force; rough buffing such as emery wheel buffing, belt sanding, flap wheel buffing, etc.; medium or finish buffing such as cotton cloth buffing and sisal buffing or a combination of such buffings, as carried out singly or in combination. The medium and finish buffings may be any of the closed face, open face and unit face types.

Prior to chrome plating, the iron-based work may be conditioned by anodic oxidization etching. This anodic oxidation etching can be carried out by an electrolytic method using the iron-based work as the anode at a temperature of about 30° to 60° C., a current density of 10 to 50 $A/dm^2$ and an electrolysis time of about 10 to 600 seconds. In place of the anodic oxidation etching or along with the etching, an acid soak treatment using hydrochloric acid, sulfuric acid or the like can be carried out.

The iron-based work is then subjected to hard chrome plating. There is no particular limitation on the composition of a chrome plating bath, and the conventional bath can be utilized. Thus, the plating bath may, for example, be a surgent bath comprising chromic anhydride $CrO_3$ and sulfuric acid, or a silico-fluoride bath comprising, in addition to chromic anhydride $CrO_3$ and $H_2SO_4$, sodium silicofluoride or potassium silicofluoride. Furthermore, the chrome plating bath may further contain at least one additional component such as silicofluoric acid, ammonium fluoride, strontium sulfate, citric acid, tartaric acid, oxalic acid, formic acid, etc. The plating bath usually contains about 0.1 to 3 g/liter of trivalent chromium.

Taking the surgent bath as an example, the chromic anhydride $CrO_3$: $H_2SO_4$ ratio is about 100:0.8 to 1.5 (g/liter). For improved corrosion resistance, the proportion of sulfuric acid to 100 g/liter of $CrO_3$ is about 0.9 to 1.3 g/liter and preferably about 1.0 to 1.25 g/liter. The covering power increases with diminishing sulfuric acid but the corrosion resistance then tends to decrease, while an increased proportion of sulfuric acid results in enhanced corrosion resistance but both adhesion and coating layer homogeneity tend to be sacrificed.

The plating bath may be a high-concentration bath, a standard bath or a low-concentration bath and the concentration of $CrO_3$ is generally about 100 to 400 g/liter, preferably about 150 to 350 g/liter, and for still better results, about 200 to 300 g/liter.

In the hard chrome plating process, lead alloy, iron or the like can be appropriately used as the anode and for improved homogeneity of the plating layer, an auxiliary cathode, a shield plate, etc. can be employed.

The plating conditions can be selected according to the plating bath composition, among others. The plating temperature is generally about 20° to 70° C., preferably about 40° to 65° C., and the current density is generally about 10 to 100 $A/dm^2$, preferably about 30 to 60 $A/dm^2$. The plating time can be selected according to the bath temperature, current efficiency, desired thickness of the plating layer, etc.

The thickness of the hard chrome plating layer can be freely selected within the range not detrimental to corrosion resistance and may for example be about 10 to 200 μm, preferably 10 to 150 μm and more preferably about 10 to 100 μm. The particularly recommendable thickness of the hard chrome plating layer is 15 to 75 μm (e.g. 25 to 75 μm) and, most desirably, about 15 to 60 μm. When the thickness of the hard chrome plating layer is too small, the corrosion resistance tends to be inadequate, while an excessively large plating thickness is not only uneconomical but requires a long plating time which detracts from productivity. Incidentally, a hard chrome plating layer of the above-mentioned thickness can be formed in, for example, about 1 to 2 hours.

Microscopic examination reveals that the hard chrome plating layer has a large number of cracks and pinholes which can be a cause of corrosion. Moreover, as pointed out in the prior art literature referred to above, heat-treatment of a hard chrome plating layer generally promotes growth of cracks.

However, when an iron-based work treated with a hard chrome plating is heat-treated and, then, impregnated with a certain resin, a high degree of corrosion resistance can be imparted to the work even if the thickness of the hard chrome plating layer is small. Moreover, without resort to the formation of a thick hard chrome plating layer and even omitting the two stages of buffing and baking as proposed by the prior art literature mentioned above, an iron-based cylindrical piston rod or other member with a remarkably high resistance to corrosion suited for use under rugged conditions can be obtained.

This invention is characterized by the treatment cycle comprising hard chrome plating, heat-treatment and resin impregnation for imparting a high corrosion resistance to an iron-based work. By practicing the above cycle, a remarkably improved corrosion resistance can be imparted to the iron-based work even if the thickness of the hard chrome plating layer is small.

The heat treatment can be carried out by virtually any of known alternative processes, such as baking, induction heating (e.g. high-frequency heating), etc. The preferred heat treatment includes baking and high-frequency heating.

The heating temperature can be liberally selected within the range conducive to improved corrosion resistance, for example not below about 150° C. (e.g. 150° to 800° C.), preferably 170° to 600° C. and more preferably about 180° to 300° C. If the heating temperature is below 150° C., it takes a long time to achieve an increased corrosion resistance, while any temperature exceeding 800° C. is too high and tends to detract from workability.

The heating temperature can be selected according to the method of heat treatment used. In the case of baking, the use of a high temperature with a low heat transfer efficiency tends to result in an increased loss of thermal energy. Therefore, the baking temperature is selected usually from the range from 150° to 400° C., preferably 170° to 350° C. and more preferably 180° to 300° C. (e.g. 200° to 300° C.). The preferred baking temperature is about 220° to 300° C. The baking time can be selected according to the baking temperature, and can be selected from the range of generally about 30 minutes to 12 hours, preferably about 1 to 10 hours and more preferably about 2 to 8 hours.

The baking treatment can be carried out with a variety of furnaces such as an infrared furnace, hot wind tunnel furnace, an electric oven and so on.

On the other hand, induction heating enables a heat treatment of iron-based work such as a cylinder rod in a short period of time with good efficiency, thus contributing greatly to the productivity of corrosion-inhibited iron-based members. Particularly, high-frequency heating provides for a high efficiency of heat treatment. In the case of high-frequency heating, the heating temperature can be suitably selected from the range of about 150° to 800° C., preferably about 170° to 600° C., more desirably about 210° to 600° C. and most desirably about 220° to 600° C. In the case of high-frequency heating, the heating temperature cannot be directly measured but the attained surface temperature of the iron-based work can be regarded as the heating temperature.

The degree of high-frequency heating can be liberally controlled by adjusting the internal diameter and width of the heating coil, the output and frequency of the high-frequency generator and the relative speed of the iron-based work with respect to the coil, among other conditions. Since these factors are interrelated, any given factor cannot be determined independently without regard to the other factors for the heat treatment.

The typical high-frequency heating conditions are now discussed taking the use of a rod measuring 30 to 100 m in outer diameter as an example. As the distance between the coil and the cylinder rod increases, the induction current is decreased and, hence, the rise of work surface temperature is inhibited. Therefore, according to the degree of heat treatment, the distance between the coil and rod can be selected within the range of, for example about 10 to 50 mm and preferably about 15 to 30 mm.

The coil width is related with the duration of heat treatment and the relative speed of the cylinder rod and coil. When the coil length is small or the work feeding rate is high, the degree of heat generation is low. Therefore, the coil length can be appropriately selected with regard to the work feeding rate but can generally be about 10 to 50 mm. The relative feeding speed of the cylinder rod with respect to the coil may for example be about 0.1 to 5 m/min. and preferably about 0.5 to 5 m/min. Compared with the baking process, the high-frequency heat treatment provides for a higher feeding rate so that highly corrosion-inhibited cylinder rods can be continuously manufactured with high efficiency and in a short time.

The output of the high-frequency generator is proportional to the energy level of induced current. Therefore, the larger the output is, the higher is the surface temperature of the cylinder rod. The output of the high-frequency generator can be selected within the range of, for example, about 30 to 150 kw. When the frequency is low, the induction current appears to flow into the depth of the cylinder rod so that a local increase in temperature is inhibited. The frequency can be selected within the range of, for example, about 3 kHz to 1 MHz, preferably about 4 to 100 kHz and more preferably about 4 to 10 KHz.

When the heat treatment is carried out by induction heating, the above-mentioned conditions can be properly selected according to the size of the iron-based cylinder rod or other work and the desired degree of heat treatment.

Where the iron-based work is a hardened steel work, the heat treatment is preferably carried out at a temperature not exceeding the tempering temperature of the iron-based work. After the heat treatment, the plated work is usually cooled gradually.

The heating time in the practice of the present invention is considerably shorter than the baking time mentioned in the prior art literature cited hereinbefore. Furthermore, in this invention, a remarkable improvement in corrosion resistance is achieved in one stage of heating. Moreover, when the above heat treatment comprising baking the hard chrome plated layer is combined with a resin impregnation process, a still greater corrosion resistance fully comparable to that of stainless steel can be imparted to an iron-based work for a long period of time.

As the heat-treated work is impregnated with a resin or sealant in the resin impregnation process, the corrosion resistance of the iron based member is remarkably enhanced probably because the multiplicity of cracks and pinholes present in the hard chrome-plating layer are filled up. The resin or sealant which can be used for the resin impregnation as a impregnant may be any kind of resin that is contributory to corrosion resistance. As the resin, there may be mentioned, for example, thermoplastic resins such as polyvinyl acetate, ethylene-vinyl acetate copolymer, polyvinyl chloride, vinyl chloride-vinyl acetate copolymer, polyvinyl acetal, acrylic resins, styrenic polymers, polyesters, polyamides, silicones, etc., thermosetting resins such as thermosetting acrylic resins, epoxy resins, urethane resins, phenolic resins, vinyl ester resins, unsaturated polyesters, diallyl phthalate resin, thermosetting silicon resins, polyimides, melamine resins, urea resins and so on. These thermosetting resins or sealants may contain a curing agent or crosslinking agent depending on their types.

The preferred resins or sealants include highly corrosion-resistant resins such as thermosetting acrylic and other resins. Further, the preferred thermosetting acrylic resin may comprises an acrylic or methacrylic oligomer and/or an acrylic or methacrylic monomer. The (meth) acrylic oligomer and monomer include, for example, a polyfunctional oligomer having 2 or more of (meth)acryloyl group such as epoxy acrylates, oligoester acrylates, urethane acrylates and the corresponding methacrylates; a polyfunctional monomer having 2 or more of (meth)acryloyl group such as ethylene glycol diacrylate, diethylene glycol diacrylate, triethylene glycol diacrylate, polyethylene glycol diacrylate, propylene glycol diacrylate, dipropylene glycol diacrylate, tripropylene glycol diacrylate, polypropylene glycol diacrylate, tetramethylene glycol diacrylate, hexane diol diacrylate, neopentyl glycol diacrylate, 2,2-bis(4-acryloyloxyethoxyphenyl)propane, 2,2-bis(4-acryloyloxydiethoxyphenyl)propane, 2,2-bis(4-acryloyloxypolyethoxyphenyl)propane, 2,2-bis(4acryloyloxypropoxyphenyl)propane, 2,2-bis(4acryloyloxydipropoxyphenyl)propane, trimethylolpropane triacrylate, pentaerythritol tetraacrylate and the corresponding methacrylates; monofunctional (meth)acrylate such as methyl acrylate, ethyl acrylate, bytyl acrylate, hexyl acrylate, octyl acrylate, phenyl acrylate, benzyl acrylate and the corresponding methacrylates. These compounds may be used singly or in combination.

In order to improve the efficiency of penetration into the hard chrome plating layer, a liquid resin or sealant, particularly a nonvolatile liquid resin or sealant is practically preferable. The resin or sealant may also be used in the form of a solution or dispersion, particularly an aqueous solution or a solution in an organic solvent. As the solvent, according to the species of resin, water and various organic solvents such as aliphatic or alicyclic hydrocarbons, aromatic hydrocarbons, halogenated hydrocarbons, alcohols, esters, ketones and ethers, inclusive of their mixtures, can be employed. The content of the nonvolatile resin or sealant in the impregnant may for example be about 0.1 to 100 weight %, preferably about 10 to 100 weight %, and more preferably about 50 to 100 weight %. The viscosity of the resin or sealant as the impregnant is selected from within the range which does not adversely affect on the impregnation, and may be practically, for example, about 1 to 50 cps, preferably about 1 to 30 cps and more preferably about 1 to 15 cps at 25° C.

Where necessary, the resin may contain various additives such as a stabilizer, agining inhibitor, colorant or coloring agent and so on.

The resin impregnation can be conducted by the conventional procedure, an example of which is soaking under atmospheric pressure, but to provide for impregnation with a greater efficiency, the impregnation is preferably carried out under reduced or elevated pressure. The impregnation is practically conducted at least under reduced pressure. It is also a good practice to subject the iron-based work to deaeration or degassing under reduced pressure prior to the impregnation process. The above-mentioned resin impregnation processes can be carried out in a suitable combination.

The resin impregnation under reduced or subatmospheric pressure can be carried out by (1) the vacuum impregnation process which comprises accommodating the chrome-plated iron-based work and the impregnating resin or sealant (preferably a liquid resin or sealant) in a given vessel or chamber and reducing the internal pressure of the vessel or chamber, (2) the vacuum soak impregnation process which comprises accommodating the chrome-plated iron-based work in a vessel or chamber, reducing the internal pressure of the vessel or chamber to deaerate gas from the defects of the hard chrome plating layer and feeding an impregnant of a resin or sealant to the vessel or chamber, or (3) the process which comprises accommodating the chrome-plated iron-based work in a vessel, reducing the internal pressure of the vessel for degassing, feeding an impregnant of a resin or sealant to the vessel for impregnation under reduced pressure and pressurizing the internal pressure of the vessel for further impregnation. The degree of vacuum for impregnation can be suitably selected and may for example be about 0.1 to 100 Torr, preferably about 1 to 50 Torr and more practically 1 to 20 Torr. The impregnation time is generally about 30 seconds to 1 hour and preferably about 1 to 30 minutes. Prior to the impregnation, the resin or sealant is practically degassed under the same or lower reduced pressure than the degree of vacuum in the resin impregnation step to avoid the development of bubbles.

The resin impregnation under elevated or supratmospheric pressure can be carried under a pressure selected according to the thickness of the chrome plating layer, chrome plating conditions, etc., for example under about 1 to 20 kg/cm$^2$ and preferably about 2 to 10 kg/cm$^2$. The impregnation time may be the same as mentioned above.

The resin impregnation can be carried out at room temperature or under heating at, for example, about 30° to 100° C. and preferably about 30° to 70° C. When a thermosetting resin or sealant is used, the impregnation temperature is often below the curing temperature of the thermosetting resin or sealant.

The above resin impregnation should be carried out at least once and may be repeated a few times. The preferred number of repetitions of impregnation is 1 to about 3. This number of impregnation repeats represents, when said impregnation under reduced pressure ms , carried out in combination with that under elevated pressure, the number of repetitions of this combination.

The present invention is characterized in that as the heat-treated hard chrome plating layer is impregnated with the resin or sealant, a high degree of corrosion resistance can be imparted even when the amount of the impregnating resin or sealant is very small. The amount of the impregnating resin or sealant is dependent on the number and depth of cracks in the hard chrome plating layer but is generally not more than 1000 mg (1 weight % or less), for example about 1 to 100 mg (0.001 to 0.1 weight %), based on 100 g of the hard chrome plating layer. The impregnating amount can be known from the weight gain due to resin impregnation.

The chrome-plated iron-based work thus impregnated with resin or sealant may be subjected to draining for removal of excess resin or sealant. The drained iron-based work may be further subjected to a cleaning operation. Since the use of a good solvent for the resin or sealant in this cleaning operation results in the elution of the resin once deposited in the defected parts of the hard chrome layer, it is advisable to use a poor solvent for the resin or sealant. The poor solvent can be selected according to the species of resin or sealant but an aqueous solvent such as water or the like can be generally employed. Cleaning with such a poor solvent may be carried out under warming or heating or be carried out by physical means utilizing water jet such as bubbling or using a jet current.

Where a thermosetting resin or sealant is used, the iron-based work is generally subjected to curing. Curing of the thermosetting resin or sealant can be carried out at a temperature which depends on the type of resin, for example at about 50° to 200° C. and preferably about 80° to 150° C. Curing of the thermosetting resin or sealant can also be carried out in hot water such as boiling water.

After the resin impregnation process described above, the hard chrome plating layer of the plated work is preferably subjected to buffing. As the hard chrome plating layer is buffed, a further improvement in corrosion resistance is attained.

This finish buffing process can be carried out in the same manner as the buffing process mentioned hereinbefore. The preferred finish buffing process comprises a series of buffings beginning with coarse buffing and ending with fine buffing. The particularly preferred buffing scheme comprises ring buffing with a cylinder of about 400 to 1000 grits followed by cotton or sisal buffing with an abrasive of about 240 to 600 grits, which is most preferably further followed by open sisal buffing. In this mode of finish buffing, not only the powerful abrasion due to ring buffing and the elimination of projections of the plating layer by cotton or sisal buffing take place but also plastic deformation occurs to plug up the openings such as cracks and smoothen the surface of the plating layer, thus contributing to enhanced abrasion resistance.

In the above method of manufacturing a corrosion-inhibited iron-based member in a treatment cycle comprising plating, heat treatment, resin impregnation and finishing, repeating said resin impregnation step at least twice results in further enhancement of corrosion resistance. In this process, a very high degree of corrosion resistance is imparted to the work even in one heating operation even if the iron-based work is prone to corrosion by nature, so that the resultant iron-based member is virtually free of corrosion.

Furthermore, when the same treatment cycle comprising plating, heat treatment, impregnation and finishing is repeated at least twice, a extremely high degree of corrosion resistance is imparted to an iron-based work even if the temperature of heat treatment is relatively low. Thus, when the temperature of heat treatment is about 150° to 200° C., the corrosion resistance that can be obtained by performing said cycle just once is somewhat poor compared with the case in which the heat treatment is carried out at about 200° to 500° C. if the thickness of the hard chrome plating layer is small. However, when the above cycle is repeated at least twice, the resultant iron-based member is substantially corrosion-free. When the temperature of heat treatment is about 200° to 500° C., a virtually corrosion-free iron-based member can be obtained even after a single cycle but as the treatment cycle is repeated a plurality of times, a still higher degree of corrosion resistance can be certainly imparted even if the hard chrome plating layer is thin. In the process repeating the treatment cycle, the temperature of heat treatment can be selected from the range, for example, from 150° to 600° C. The resin impregnation process is practically carried out at least under reduced pressure, and, if necessary, in combination with elevated pressure, in many instances.

The number of repetitions of the treatment cycle may be 2 or more and is generally 2 or 3. When the hard chrome plating step is carried out a plurality of times, the thickness of the hard chrome plating layer to be formed each time may be selected from the above-mentioned range of 10 to 200 μm depending on the number of repetitions of the plating step and may for example be about 10 to 100 μm and preferably about 15 to 50 μm.

In the hard chrome plating scheme comprising two or more plating steps, if the second or subsequent hard chrome plating is performed following resin impregnation, the resin previously applied generally interferes with the formation of a homogeneous hard chrome plating layer. However, since the above-mentioned cycle includes a buffing step following a resin impregnation step, a homogeneous hard chrome plating layer can be invariably obtained even if the plating step is carried out a plurality of times.

The final thickness of the whole hard chrome plating layer thus obtained may for example be about 5 to 100 μm, preferably 10 to 80 μm, and for still better results, about 15 to 75 μm. The particularly preferred total thickness of the hard chrome plating layer as a whole is about 15 to 50 μm (e.g. 20 to 50 μm). The resultant iron-based member, for example a cylinder rod, will not be corroded even under rugged conditions, such as the conditions of a salt spray test, even if cracks are present in the plating layer.

By way of illustration, even after 96 hours of the CASS test designated in Japanese Industrial Standards JIS H 8502 (1988), the rating number which is an indicator of the area of corrosion is about 9.0 to 10.0 (e.g. 9.3 to 10.0), preferably about 9.5 to 10.0, more preferably about 9.8 to 10.0, and particularly about 10.0. Thus, virtually no corrosion takes place. Moreover, even after 1,200 hours of the salt spray test defined in JIS H 8502, there is substantially no corrosion with a rating number of about 9.5 to 10.0, preferably about 9.8 to 10.0, and particularly about 10.0.

By the method of the present invention, a high degree of corrosion resistance can thus be imparted to a corrodible iron-based work. Therefore, the invention can be advantageously applied to various corrodible iron-based works, for example those for iron-based members intended for use in a corrosive environment or in an environment favoring corrosion, particularly sliding members which tend to suffer decreases in corrosion resistance on repeated sliding contact. Particularly, this invention is applicable to various cylindrical rods, for example cylinder rods for construction machines and especially piston rods.

In order to insure controlled reciprocation of the piston or other rod, the rod may have recesses for position detection along its axial length, for example a plurality of recesses disposed dispersedly in the axial direction, preferably a plurality of grooves each extending in the circumferential direction of the rod at a predetermined pitch.

In such a cylindrical rod, the positions of the plurality of circumferential grooves can be detected with position sensors (for example, solenoid position sensors which perform detections from changes in magnetic resistivity or potentiometers which perform detections from changes in electrostatic capacitance). Among preferred sensors is an electromagnetic position sensor which utilizes the phenomenon that an eddy current corresponding to each groove flows and detects the depth or width of the groove by magnetic means. Therefore, when the rod is used as a piston rod for a cylinder, the extent of advance or retreat of the piston rod can be detected by counting the detection signals generated in response to the movement of the piston rod in normal or reverse direction with respect to the cylinder.

The recesses for position detection are preferably annular or spiral grooves formed in the entire periphery of the rod or grooves extending at least over a part of the rod in the circumferential direction along the axial length of the rod. The particularly recommendable grooves for position detection are those extending in the circumferential direction normal to the axis of the rod in regions along the axial direction of the rod.

The above-mentioned pitch of grooves can be selected from the range insuring a sufficient accuracy of groove position detection and may for example be about 0.1 to 50 mm and preferably about 0.5 to 25 mm. The depth of grooves can also be selected from the range insuring the required machinability and may for example be about 1 to 200 μm, preferably about 10 to 150 μm, and more preferably about 25 to 100 μm.

The groove structure of the iron-based rod may include reference grooves serving as markers. The cylinder rod having such reference markers has a plurality of position detection grooves extending at a predetermined pitch in the circumferential direction along its axis and reference grooves extending at a pitch larger than the pitch of the position detection grooves in the circumferential direction.

With such a rod, the reference grooves can be utilized as reference markers and using the detection signals from the position sensors detecting the reference grooves as reference signals, the rod can be driven in normal or reverse direction with respect to the cylinder according to the reference signals.

With the rod provided with reference grooves, the detection signals associated with the eddy currents due to the reference grooves can be utilized as reference signals and, therefore, it is not necessary to return the rod into the cylinder once and, then, advance the rod, with the result that the stroke for returning the rod to a reference position can be decreased. Moreover, the rod can be advanced or retracted by a predetermined stroke by counting the detection signals associated with the eddy currents generated in the position detection grooves.

The reference grooves need not be grooves as such but may be recesses similar to the aforesaid position detection recesses. The preferred reference recesses are grooves which, as aforesaid, extend at least over a part of the rod in the circumferential direction along the axis of the rod. The particularly preferred reference grooves extend in the circumferential direction to the axis of the rod in regions along the axis of the rod.

In such a cylinder rod, the aforesaid position detection recesses and reference recesses are filled up with the hard chrome plating layer and the surface of the rod is covered with the hard chrome plating layer having a smooth hard chrome plated surface.

The cylinder rod described above can be manufactured by forming a plurality of recesses in the axial direction of an iron-based work and, then, forming a hard chrome plating layer in the manner described above. The recesses of the cylinder rod may be formed by forming a resist layer excluding the areas corresponding to the recesses by screen printing, photoresist, tape masking or any other suitable method and, then, etching off the unmasked areas.

In the formation of a hard chrome plating layer, it is recommendable to mask the surface of the rod excepting the recesses, apply hard chrome plating, remove the mask and again apply hard chrome plating. In this connection, not only the buffing but also a suitable combination of the resin impregnation and heat treatment may be carried out after each hard chrome plating, or the resin impregnation and heat treatment may be performed in combination with buffing in a final step following the second hard chrome plating.

Even though the chrome plating and the iron of the iron-based rod are coexistent after unmasking, it is good practice, for efficient etching of the surface of the iron-based rod, to perform etching using an etching solution, preferably one containing ferric chloride, so as to condition the ground surface. By performing etching by the anodic oxidation thereafter, the surface of the chrome plating layer is also etched so that the whole surface of the iron-based rod can be cleaned and activated.

The following examples are intended to describe this invention in further detail and should not be construed as defining the scope of the invention.

EXAMPLES

EXAMPLE 1

A low carbon steel (S43C) rod, 25 mm in outer diameter, was degreased and buffed with a #320 ring buff, a #600 ring buff, a #800 ring buff, and a sisal buff in this order. Then, an etching was performed in the following plating bath by anodic oxidation using the rod as the positive pole at a current density of 35A/dm$^2$ for 3 minutes.

[Plating bath composition]

Chromic anhydride: 250 g/liter

Sulfuric acid: 2.5 g/liter

Trivalent chromium: 1.0 g/liter

Then, the rod was chrome-plated at the bath temperature of 50° C., current density of 35A/dm$^2$ and plating time of 100 minutes to form a 35 μm-thick hard chrome plating layer.

The resultant plated rod was baked at 180° C. for 5 hours, and after gradual cooling, subjected to resin impregnation. This resin impregnation process was carried out using an impregnating dope containing an acrylic resin impregnating agent (Diaftoc Co., Ltd., Japan; Trade name: DIAKITE PF-1900) and a curing agent (Diafloc Co., Ltd., Japan; Trade name: A-1).

Thus, the internal pressure of a vacuum chamber accommodating the hard chrome-plated rod was reduced to 5 Torr with a vacuum pump for 10 minutes and the impregnating dope was fed to the chamber. This vacuum impregnation was carried out at 5 Torr for 10 minutes, at the end of which time the chamber was exposed to the atmosphere. The internal pressure of the chamber was then increased and the impregnation under elevated pressure was carried out at 5 kg/cm$^2$ for 10 minutes. The rod was taken out and drained of excess impregnating dope and heated in a drying oven at 150° C. for 30 minutes to cure the resin and provide a resin-impregnated hard chrome-plated rod.

After the rod was allowed to cool, it was subjected to finish buffing to provide a hard chrome-plated piston rod. The finish buffing was performed with a #800 ring buff and then, a sisal buff. After this finish buffing, the thickness of the hard chrome plating layer was 30 μm.

EXAMPLE 2

A piston rod was obtained in the same manner as in Example 1 except that the plated rod was baked at 230° C. for 5 hours and a hard chrome plating layer having a thickness of 25 μm was formed by buffing.

EXAMPLE 3

A low carbon steel rod similar to the one used in Example 1 was pretreated by degreasing, buffing and etching and, then, using the plating bath described in Example 1, chrome plating was performed at a bath temperature of 50° C., a current density of 35A/dm$^2$ and a plating time of 60 minutes to form a 20 μm-thick hard chrome layer.

This hard chrome-plated rod was baked at 180° C. for 5 hours and, then, subjected to resin impregnation as in Example 1. The plated rod was then drained of excess impregnating dope and heated for curing of the resin in a heating oven at 150° C. for 30 minutes to provide a resin-impregnated hard chrome-plated rod.

After gradual cooling, the rod was subjected to finish buffing in the same manner as Example 1 to form a 15 μm-thick hard chrome plating layer.

This hard chrome-plated rod was then subjected to the same chrome plating process as described above to form a 20 μm-thick hard chrome plating layer on top of the previous plating layer (total thickness=35 μm) and the rod was further baked at 180° C. for 5 hours, impregnated with the resin and finish buffing to provide a piston rod having a 30 μm-thick hard chrome plating layer.

EXAMPLE 4

The procedure of Example 3 was repeated except that the baking temperature was set at 190° C. for the two baking steps to provide a piston rod.

COMPARATIVE EXAMPLE 1

A piston rod having a 30 μm-thick hard chrome plating layer was obtained in the same manner as in Example 1 except that the baking process was omitted.

COMPARATIVE EXAMPLE 2

A piston rod having a 30 μm-thick hard chrome plating layer was obtained in the same procedure as in Example 1 without the resin impregnation.

COMPARATIVE EXAMPLE 3

The procedure of Example 1 was repeated except that the baking and resin impregnation processes were omitted to provide a piston rod having a 30 μm-thick hard chrome plating layer.

EXAMPLE 5

The procedure of Example 1 was repeated except that a low carbon steel (S43C) measuring 65 mm in outer diameter (total length of rod, 590 mm; shaft length 120 mm) was used to form a 30 μm-thick hard chrome plating layer.

Then, the rod was disposed in the cavity or hollow of a coil (86 mm in inside diameter and 20 mm wide) and a high-frequency heat treatment was carried out at a voltage of 300V, H-F generator output power and frequency of 50 kW and 5.0 KHz, and coil feed speed of 2.8 m/min. The measured surface temperature of the rod treated under the above conditions was 220° C.

The heat-treated piston rod was resin-impregnated in the same manner as in Example 1 and finally finish-buffed to provide a cylinder rod having a 27 μm-thick hard chrome plating layer.

EXAMPLE 6

Using the same coil as used in Example 4, the procedure of Example 4 was repeated except that the high-frequency heat treatment was carried out at a voltage of 460V, H-F generator output power and frequency of 80 kW and 6.0 KHz, and coil feed speed of 3.3 m/min. to provide a cylinder rod. The measured surface temperature of the rod thus H-F treated under the above conditions was 500° C.

The piston rods obtained in the above examples and comparative examples were subjected to the CASS test according to JIS H 8502 (1988) and the time course of formation of corrosion defects (corrosion resistance) was evaluated against the rating number standard chart. The test solution for the CASS test was prepared by dissolving 0,268 g of cupric chloride dihydrate in 40 g/liter aqueous sodium chloride solution and adjusting the solution to pH 3.0 with acetic acid. The CASS test was performed at 50° C. The results are set forth in Table 1.

In corrosion testing, even if the actual degree of actual corrosion is low, rust spreads from corrosion pits to cause an apparent overestimation of the degree of corrosion. Therefore, in the presentation of results after 48 hours of the test, not only the degree of corrosion of each test rod as such but also the degree of corrosion of the rod after cleaning of the rod surface by wiping are shown.

Each rating number standard chart corresponds to the total corrosion area rate (%) and the relation between total corrosion area and rating number is that, as shown below, the larger the number is, the higher is the corrosion resistance of the test specimen.

| Total corrosion area (%) | Rating number |
|---|---|
| 0 | 10.0 |
| 0 to 0.02 | 9.8 |
| 0.02 to 0.05 | 9.5 |
| 0.05 to 0.07 | 9.3 |
| 0.07 to 0.10 | 9.0 |
| 0.10 to 0.25 | 8 |
| 0.25 to 0.50 | 7 |
| 0.50 to 1.00 | 6 |
| 1.00 to 2.50 | 5 |
| 2.50 to 5.00 | 4 |
| 5.00 to 10.0 | 3 |
| 10.0 to 25.0 | 2 |
| 25.0 to 50.0 | 1 |

TABLE 1

| | CASS test time | | | |
|---|---|---|---|---|
| | | | 48 hours | |
| | 6 hours | 24 hours | before cleaning | after cleaning |
| Example 1 | 10.0 | 9.8 | 9.3 | 10.0 |
| Example 2 | 10.0 | 9.8 | 9.3 | 10.0 |
| Example 3 | 10.0 | 10.0 | 9.8 | 10.0 |
| Example 4 | 10.0 | 9.8 | 9.5 | 10.0 |
| Comparative Example 1 | 9.8 | 9.0 | 8.0 | 9.0 |
| Comparative Example 2 | 9.8 | 8.0 | 7.0 | 8.0 |
| Comparative Example 3 | 6.0 | 2.0 | 1.0 | 3.0 |
| Example 5 | 10.0 | 9.8 | 9.3 | 10.0 |
| Example 6 | 10.0 | 9.8 | 9.3 | 10.0 |

As apparent from Table 1, the piston rods of Examples is remarkably improved in the corrosion resistance comparison with the piston rods of Comparative Examples which were obtained without heat treatment or resin impregnation. Furthermore, the combination of the heat treatment and the resin impregnation imparts a extremely high corrosion resistance to the piston rods. Particularly, when the plating treatment, heat treatment and resin impregnation are repeated a plurality of times, the corrosion resistance of the piston rods can be improved remarkably.

COMPARATIVE EXAMPLE 4

A piston rod having a 50 μm-thick hard chrome plating layer was obtained in the same manner as in Example 1 except that a stainless steel (SUS304) rod having a outer diameter of 40 mm was chrome-plated for a longer time than 100 minutes.

COMPARATIVE EXAMPLE 5

A piston rod having a 25 μm-thick hard chrome plating layer was obtained in the same manner as in Example 1 except that a 30 μm-thick hard chrome plating layer was formed on a low carbon steel (S43C) rod having a outer diameter of 40 mm and the heat treatment was conducted at 120° C. for 30 minutes.

EXAMPLE 7

A piston rod having a 25 μm-thick hard chrome plating layer was obtained in the same manner as in Example 1 except that a 30 μm-thick hard chrome plating layer was formed on a low carbon steel (S43C) rod having a outer diameter of 40 mm and the heat treatment was conducted at 250° C. for 4.5 hours.

EXAMPLE 8

A piston rod having a 25 μm-thick hard chrome plating layer was obtained in the same manner as in Example 7 except that the heat treatment was conducted at 250° C. for 6 hours.

EXAMPLE 9

A piston rod having a 30 μm-thick hard chrome plating layer was obtained in the same manner as in Example 1 except that a 30 μm-thick hard chrome plating layer was formed on a low carbon steel (S43C) rod having a outer diameter of 40 mm, heat treatment was carried out at 250° C. for 6 hours, and then the resin impregnation was repeated twice.

EXAMPLE 10

A low carbon steel (S43C) rod having a outer diameter of 40 mm was pretreated by degreasing, buffing and etching, and, then, using the plating bath of Example 1, chrome plating was conducted at a bath temperature of 50° C. and a current density of 35 A/dm$^2$ to form a hard chrome layer of 30 μm in thickness.

The resultant plated rod was baked at 200° C. for 4.5 hours, and resin impregnation was conducted in the same manner in Example 1. The excess impregnant was removed by washing with water and a hot water of 90° C. and heated in a drying oven at 150° C. for 30 minutes to cure the resin and provide a resin-impregnated hard chrome-plated rod.

After the rod was allowed to cool, it was subjected to finish buffing process as in Example 1 to form a hard chrome plating layer of 20 μm in thickness.

The resultant hard chrome-plated rod was then subjected to the same chrome plating process as described above to form a 30 μm-thick hard chrome plating layer on top of the previous plating layer (total thickness=50 μm) and the rod was further baked at 200° C. for 4.5 hours, impregnated with the resin and finish buffing to provide a piston rod having a 35 μm-thick hard chrome plating layer.

EXAMPLE 11

A piston rod was obtained in the same manner as in Example 10 except that the baking was conducted at 250° C. for 4.5 hours in each baking step.

EXAMPLE 12

A piston rod was obtained in the same procedure as in Example 10 except that a hard chrome plating layer of 15 μm was formed in each plating step and the baking was conducted at 250° C. for 6 hours in each baking step.

The piston rods obtained in the examples 7-12 and comparative examples 4 and 5 were subjected to the same CASS test as described above and the degree of formation of corrosion defects (corrosion resistance) after hours and 480 hours was evaluated against the rating number standard chart. Further, the piston rods were subjected to a neutral salt spray test (initial concentration of sodium chloride: 40g/liter, pH=6.5–7.2) and the degree of corrosion defects after 1,200 hours was evaluated against the rating number standard chart. For reference, the piston rod obtained by repeating the procedure in Comparative Example 3 was also subjected to the above tests and the degree of corrosion defects was evaluated. The results are shown in Table 2.

TABLE 2

| | CASS test | | | | |
|---|---|---|---|---|---|
| | 96 hours | | 480 hours | | Salt spray |
| | before cleaning | after cleaning | before cleaning | after cleaning | test 1,200 hours |
| Com. Ex. 3 | 1.0 | 8.0 | 1.0 | — | 5.0 |
| Com. Ex. 4 | 9.8 | 10.0 | 6.0 | 6.0 | 9.8 |
| Com. Ex. 5 | 1.0 | 8.0 | 1.0 | 5.0 | 5.0 |
| Example 7 | 9.0 | 10.0 | 9.0 | 10.0 | 9.8 |
| Example 8 | 10.0 | 10.0 | 10.0 | 10.0 | 10.0 |
| Example 9 | 10.0 | 10.0 | 10.0 | 10.0 | 10.0 |
| Example 10 | 9.3 | 10.0 | 9.0 | 10.0 | 10.0 |
| Example 11 | 10.0 | 10.0 | 9.5 | 10.0 | 10.0 |
| Example 12 | 10.0 | 10.0 | 10.0 | 10.0 | 10.0 |

As apparent from Table 2, the increased temperature in the heat treatment, a plurality of the impregnation, or repetitions of plating, heat treatment and impregnation provides a piston rod which is substantially free of corrosion. The piston rods of Examples have a high gross or luster and water repellent. Particularly, the corrosion resistance of the piston rods of Examples 8 to 12 are improved remarkably and are comparable or superior to the stainless steel-based piston rod of Comparative Examples 4. In the piston rods of Examples 8–12, there is no corrosion. In the piston rod of Comparative Example 3, the chrome plating layer is corroded after 480 hours (corresponding to 20 cycles) of the CASS test to produce a white-rust, and a slight red rust is developed in the salt spray test.

What is claimed is:

1. A method of producing a corrosion-inhibited iron-based member which comprises subjecting a corrodible iron-based rod to hard chrome electroplating, heat treatment at a temperature of not less than 150° C., impregnation with a liquid curable resin or sealant under at least subatmospheric pressure to form a hard chrome electroplating layer having cracks and pinholes, a curing agent for curing the impregnating resin or sealant in situ and finish buffing, wherein, in said impregnation step, the cracks and pinholes present in said hard chrome electroplating layer are impregnated with said liquid curable resin or sealant.

2. A method of producing a corrosion-inhibited iron-based member according to claim 1 which comprises an electroplating step for forming a hard chrome electroplating layer of from 10 to 100 μm in thickness on a cylindrical rod, a heat treatment step for heating the plated rod at a temperature of 170° to 600° C., a resin impregnation step for impregnating the heat-treated rod with a liquid thermosettable resin or sealant under at least subatmospheric pressure, a curing step for curing the impregnating resin or sealant in situ and a finishing step for buffing the resin-impregnated rod.

3. A method of producing a corrosion-inhibited iron-based member according to claim 1 wherein the liquid curable resin or sealant is a nonvolatile liquid thermosettable resin or sealant.

4. A method of producing a corrosion-inhibited iron-based member according to claim 1 wherein said heat treatment is carried out at a temperature of 180° to 300° C. for 30 minutes to 12 hours.

5. A method of producing a corrosion-inhibited iron-based member according to claim 1 wherein a liquid thermosettable resin or sealant comprising an acrylic or methacrylic oligomer or a monomer and having a viscosity of 1 to 50 cps at 25° C. is used.

6. A method of producing a corrosion-inhibited iron-based member according to claim 1 wherein said impregnation is carried out under reduced pressure of 0.1 to 100 Torr.

7. A method of producing a corrosion-inhibited iron-based member according to claim 2 wherein the hard chrome plating layer is finish-buffed to provide for a thickness of 5 to 95 μm.

8. A method of improving the corrosion resistances of a corrodible iron-based cylindrical rod which comprises subjecting said iron-based rod to a process comprising an electroplating step for forming a hard chrome electroplating layer of from 15 to 60 μm in thickness, a heat treatment step for heating the plated rod at a temperature of 180° to 300° C., a resin impregnation step for impregnating, under 1 to 50 Torr, the heat treated rod with a nonvolatile liquid thermosettable resin or sealant having a viscosity of 1 to 15 cps at 25° C. to form a hard chrome electroplating layer having cracks and pinholes, a curing step for curing the impregnated resin or sealant and a finishing step for finish-butting the resin-impregnated rod, wherein, in said resin impregnation step, the cracks and pinholes present in said hard chrome electroplating layer are impregnated with said liquid thermosettable resin or sealant.

* * * * *